US006557324B1

(12) United States Patent
Campagnoli et al.

(10) Patent No.: US 6,557,324 B1
(45) Date of Patent: May 6, 2003

(54) METHOD AND DEVICE FOR CONTINUOUSLY WRAPPING PRODUCTS

(75) Inventors: Enrico Campagnoli, Sant'Agata Bolognese (IT); Antonio Gamberini, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 09/701,881

(22) PCT Filed: Apr. 6, 2000

(86) PCT No.: PCT/IB00/00421

§ 371 (c)(1),
(2), (4) Date: Dec. 5, 2000

(87) PCT Pub. No.: WO00/61436

PCT Pub. Date: Oct. 19, 2000

(30) Foreign Application Priority Data

Apr. 8, 1999 (IT) ..... BO99A0161

(51) Int. Cl.[7] ..... B65B 11/36; B65B 7/02

(52) U.S. Cl. ..... 53/466; 53/491; 53/234; 53/376.5

(58) Field of Search ..... 53/225, 234, 370.3, 53/373.3, 376.5, 377.2, 466, 491

(56) References Cited

U.S. PATENT DOCUMENTS 684,788 A * 10/1901 Burbank ..... 53/376.5
1,857,680 A * 5/1932 Van der Pyl ..... 53/376
1,961,646 A * 6/1934 Smith ..... 53/370.3
2,810,246 A * 10/1957 Cornock ..... 53/376.5
3,374,604 A * 3/1968 Roesner ..... 53/377.2
3,645,068 A * 2/1972 Langen ..... 53/376.5
4,483,125 A * 11/1984 Suga ..... 53/547

FOREIGN PATENT DOCUMENTS

GB 454864 10/1936
GB 2 297 957 8/1996

* cited by examiner

*Primary Examiner*—John Sipos
(74) *Attorney, Agent, or Firm*—The Law Offices of Timothy J. Klima

(57) ABSTRACT

In a method and device for continuously wrapping products (3), while the products (3) are being fed continuously at a first speed (V1) along an intermediate portion (44) of a first path (P1) and in a first direction (D1), together with their intermediate wrappers **(2*a*), the latter having a first and a second wing (37, 38), projection from, and on opposite sides of a surface (30) of the product (3), the wings (37, 38) make contact with a first folder (43) that moves at a second speed (V2) which is faster than the first speed (V1) in a second direction (D2) coinciding with the first speed (D1) along a section (45) of a second a path (P2). The section (45) substantially coincides with the intermediate portion (44) of the first path (P1), so as to enable the first folder (43) to fold the first wing (37) towards the surface (30) of the product (3) and the second wing (38) away from the surface (30) until the second wing is in a position such that it extends from the surface (30) in the same plane, and where a gumming device (64) gums a portion of the wing (38), after which a second folder (65) folds the second wing (38) back towards the surface (30) so that its gummed portion comes into contact with the first wing (37)**

18 Claims, 6 Drawing Sheets

METHOD AND DEVICE FOR CONTINUOUSLY WRAPPING PRODUCTS

TECHNICAL FIELD

Figure 1:
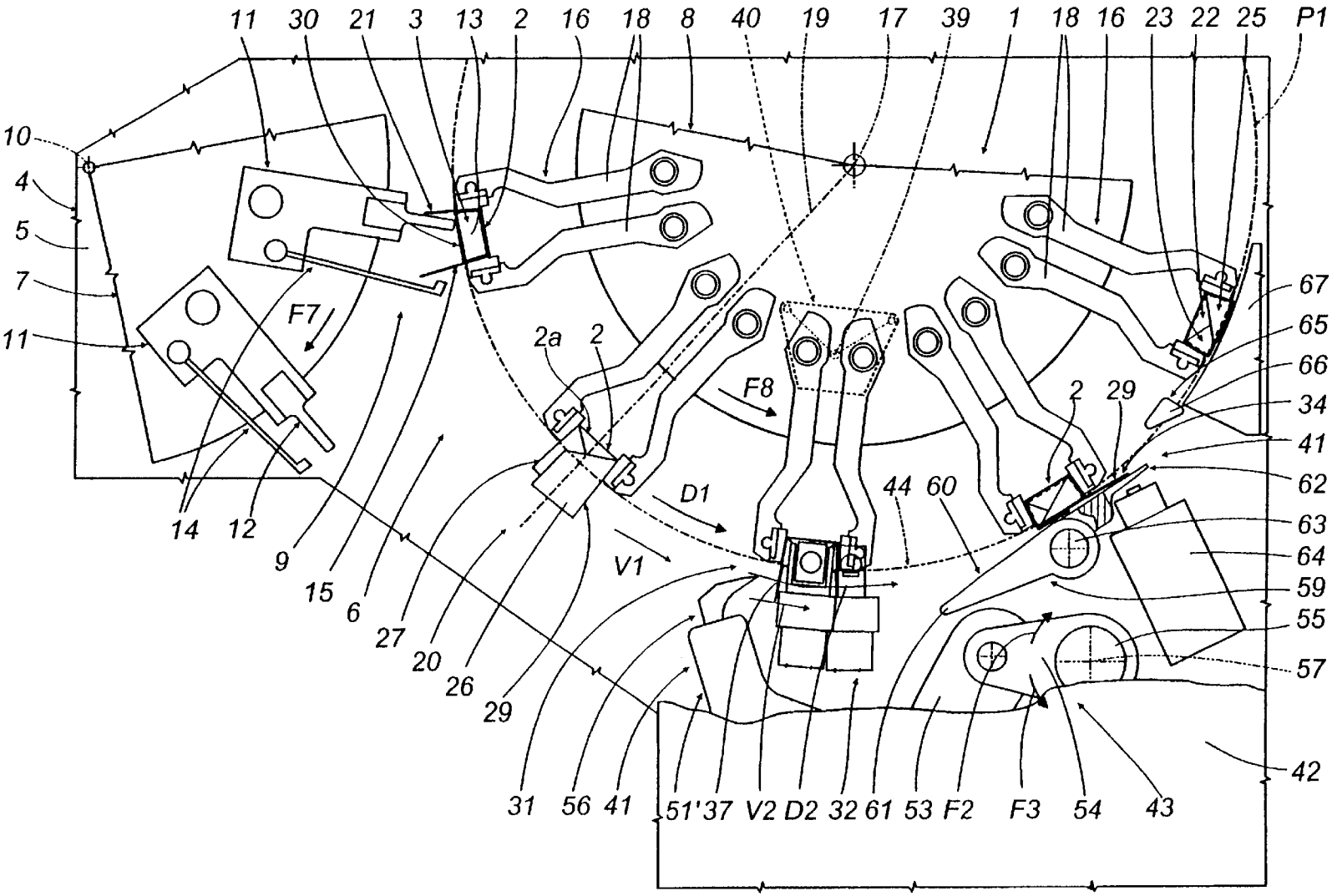

The present invention relates to a method for continuously wrapping products.

The present invention is advantageously used in the wrapping of foodstuffs, such as chocolates and similar products, to which the following description refers, but without thereby restricting the scope of the inventive concept.

BACKGROUND ART

In wrapping machines, a succession of products is positioned at regular intervals and fed in an orderly manner along a given path to a pick-up station, where the products are gripped by transfer means and fed firstly to a feed station, in which a sheet of wrapping material is associated with each product and, gradually, through a succession of folding stations, designed to form a closed wrapper around each product to be wrapped.

The products are normally fed to the pick-up station by an infeed conveyor, whilst the transfer means normally consist of a rotary conveyor equipped with a plurality of peripheral pick-up grippers, which move towards the conveyor in order to pick up the products in succession and transfer them to a first wrapping drum.

The first wrapping drum rotates about an axis of rotation and has a plurality of peripheral pick-up units, designed to pick up the products and feed them through the feed station and along a folding station in which each sheet is partially wrapped around the related product to form a wrapper which is substantially folded in a U-shape.

The sets consisting of the products and the related sheets are then transferred, at a transfer station, to a second wrapping drum, whose axis of rotation is parallel with the axis of rotation of the first drum. The second wrapping drum, in turn, has a plurality of peripheral pick-up units, each consisting of a pair of jaws set opposite one another, projecting radially away from the drum and arranged symmetrically relative to an axis which is substantially radial relative to the drum. Said jaws are designed to follow a substantially circular path about the axis of rotation of the second drum, in order to feed the sets consisting of the products and sheets through the succession of folding stations.

The folding operations to which each sheet folded into a U-shape must be subjected in order to obtain a closed wrapper surrounding the product envisage a first step in which each of the two sides of the sheet projecting beyond the corresponding side of the product are folded, thus further folding the sheet of wrapping material, which assumes the form of a box-shaped, substantially parallelepiped intermediate wrapper inside whose top portion, facing the second drum, the product is housed, whilst the opposite part, the bottom, is open and consists of four side flaps. The side flaps project away from the drum and away from a bottom surface of the product. Pairs of the side flaps are substantially opposite to and parallel with one another and parallel with the axis of symmetry of the pick-up jaws and, specifically, two of the side flaps are parallel with the plane in which the second drum lies and with the circular path.

The intermediate wrapper must then be subjected to a series of folding operations in order to obtain a closed wrapper. Firstly, each of the first two opposite flaps, parallel to the placement plane of the aforementioned circular path, are squarely folded so as to form two substantially rectangular tabs placed in direct contact with the bottom surface of the product and usually partly overlapping, and, for each of the other two second flaps which are parallel to each other and perpendicular to the first flaps, two corresponding triangular end portions are also folded, in such a way as to change the shape of the second flaps, which assume a substantially triangular shape to form a pair of parallel wings substantially perpendicular to the bottom surface of the product. These wings are then folded over each other to close the wrapper.

The folding of the above mentioned wings, which are substantially perpendicular to the bottom surface of the product, is usually performed by a movable folder whose jaws, as they move along the feed path, squarely fold one of the two wings until it is in contact with the tabs which are lying flat against the bottom surface of the product, while a fixed folder located along the path intercepts and squarely folds the other wing until it is in partial contact with the previous wing.

This folding method has the disadvantage that, if the wrapper has to be closed by gumming the wing that is folded squarely over the other, the gumming operation cannot be done properly in synchrony with the other folding steps and without stopping the product—sheet of wrapping material sets during the wrapping cycle.

This constitutes a drawback particularly in the latest-generation wrapping machines which are designed to operate continuously to increase productivity.

Besides slowing down the wrapping cycle, there are also more chances that the wrapper which has just been folded and closed over the product will open again, especially when the wrappers are made from elastic materials that do not easily keep their folds, thus resulting in a relatively high number of finished products being rejected when they are fed out of the machine to a receiving unit.

DISCLOSURE OF THE INVENTION

The aim of the present invention is to provide a method for continuously wrapping products which allows the triangular wings of a partial wrapper to be folded in such a way that the product B sheet of wrapping material sets do not need to stop and in such a way that an adhesive can be applied by a gumming unit to one of the wings so as to keep the finished wrapper properly closed.

Accordingly, the present invention provides a method for continuously wrapping products, characterized in that it comprises the following steps: continuously feeding, at a first defined speed, along a first path and in a first given direction, a succession of products and the corresponding sheets of wrapping material at least partially wrapped around the products to form an intermediate wrapper having a first and a second wing that are substantially transversal to the plane in which the first path lies, project from a surface of the products and are located on opposite sides of the product; folding the first wing towards said product surface and folding the second wing away from the surface using a first folding device that cooperates with the first and second wings as the intermediate wrapper and the product move forward continuously along an intermediate folding portion of the first path; gumming at least one portion of the second wing; folding back the second wing towards the product surface until its gummed portion comes into contact with the first wing, using a second folding device that cooperates with the second wing as the intermediate wrapper and the product move forward continuously along the intermediate folding portion.

The present invention also relates to a device for continuously wrapping products characterized in that it comprises, along a portion of a wrapping machine equipped with a frame and a wall, a wrapping device comprising means for continuously feeding at a first defined speed, along a first path and in a defined first direction, a succession of products and the corresponding sheets of wrapping material at least partially wrapped around the products to form an intermediate wrapper having a first and a second wing that are substantially transversal to the plane in which the first path lies, project from a surface of the products and are located on opposite sides of the product; a first folding device that cooperates with the first and second wings as the intermediate wrapper and the product move forward continuously along an intermediate folding portion of the first path and that is designed to fold the first wing towards said product surface and to fold the second wing away from the surface; a gumming device designed to apply an adhesive to at least one portion of the second wing; a second folding device that cooperates with the second wing as the intermediate wrapper and the product move forward continuously along the intermediate folding portion and that is designed to fold the second wing towards the product surface until its gummed portion comes into contact with the first wing.

The present invention will now be described with reference to the accompanying drawings, which illustrate an embodiment of the invention, without limiting the scope of Its application, and in which:

FIG. 1 is a schematic side view, with some parts cut away to better illustrate others, of a portion of a wrapping machine equipped with a wrapping device that implements the method according to the present invention for folding the flaps of a product wrapper;

FIGS. 1*a* to 1*f* are perspective views of a succession of steps for folding a wrapper around the relative product;

FIGS. 2 to 9 are schematic side views of the folding device in a succession of operating steps.

With reference to FIG. 1, the numeral 1 indicates, as a whole, a portion of a wrapping machine designed to apply wrappers 2 around products which, in the case in question, are chocolates 3 which substantially have the shape of a parallelepiped.

The portion 1 of the wrapping machine has a frame 4 with a vertical front wall 5, and comprises a wrapping device 6 with a first wrapping drum 7 and a second wrapping drum 8 of the known type and tangential to one another at a transfer station 9. The first and second wrapping drums 7, 8 are only partially illustrated and are of the type described in European patent applications No. 608,823 and No. 608,824, which should be consulted for a more complete description of their structure and operation. The drum 7 is supported by the wall 5 in such a way that it rotates about an axis 10 which is horizontal and perpendicular to the wall 5, at a substantially constant speed and in a clockwise direction according to the arrow F7 in FIG. 1. The drum 7 comprises a plurality of peripheral, radial gripper pick-up units 11, each comprising two jaws 12 (only one of which is visible), mobile towards one another in a direction substantially perpendicular to the wall 5 to cooperate with the opposite longitudinal ends 13 of a chocolate 3 positioned with its longitudinal axis 3*a* (FIG. 1*a*) perpendicular to the wall 5, and another jaw 14 for gripping a sheet 15 of wrapping material fed from a feed device of a known type, not illustrated.

Figure 1A:
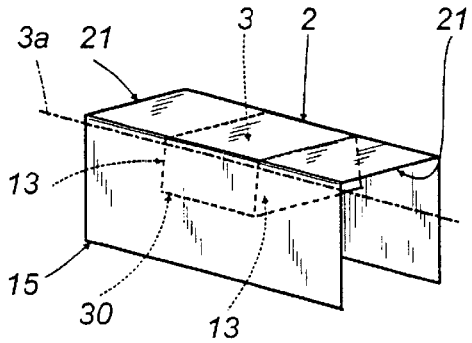

Each unit 11 is designed to bring together, in the known way, each chocolate 3 and a relative sheet 15 of wrapping material, and to fold the sheet 15 into an L-shape, then, as is more specifically illustrated in FIG. 1*a*, into a U-shape around the relative chocolate 3 while transferring the chocolate 3 from the unit 11 to a corresponding peripheral gripper pick-up unit 16 on the second drum 8 at the station 9.

The drum 8 is supported by the wall 5 in such a way that it rotates about an axis 17 which is horizontal and perpendicular to the wall 5 and parallel with the axis 10 of the drum 7, at a substantially constant speed and in a counterclockwise direction according to the arrow F8 in FIG. 1. The second drum also has a plurality of peripheral pick-up units 16, each comprising a pair of opposite jaws 18 which project radially away from the drum 8 and are arranged symmetrically relative to an axis 19 which is substantially radial relative to the drum 8. Each unit 16 is designed to oscillate relative to the drum 8 about an axis 39, which is parallel to the axis 17, under the action of a cam actuator device 40 of a known type and hence illustrated only partly and schematically with a dashed line.

As shown in FIG. 1, the jaws 18 are designed to follow a substantially circular path P1 about the axis 17, in order to feed the sets consisting of the chocolates 3 and sheets 15 along the path P1 through a known folding station 20.

Figure 1B:
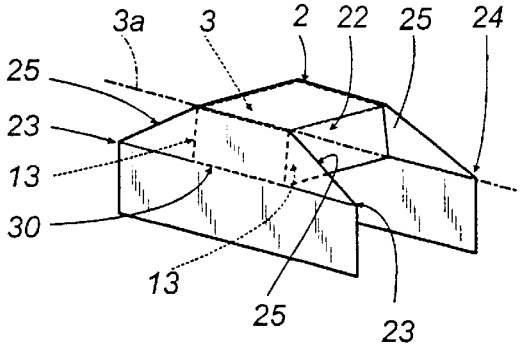
Figure 1C:
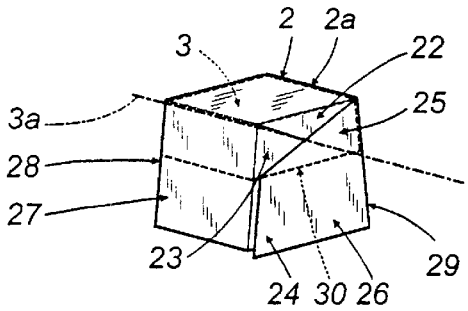

At the folding station 20, as illustrated in more detail in FIGS. 1*b* and 1*c*, each longitudinal end 21 of the sheet 15 folded in a U-shape, which projects beyond the corresponding longitudinal end 13 of the relative chocolate 3, is folded in the known way to define a small, substantially rectangular wing 22, in direct contact with the longitudinal end 13 of the chocolate 3, and a large inner wing 23 and a large outer wing 24, both substantially trapezoidal in shape and respectively having side inner reinforcing wings 25, which are substantially triangular, connecting the trapezoidal wings 23 and 24 to the rectangular wings 22 (FIG. 1*b*).

As illustrated in FIGS. 1 and 1*c*, the two trapezoidal wings 23 and 24 are then folded towards the rectangular wing 22, with the trapezoidal wing 24 partially above the trapezoidal wing 23, thus further folding the sheet 15 of wrapping material, which assumes the shape of a box-shaped intermediate wrapper 2*a*, substantially a parallelepiped, whose top portion facing the second drum 8 (FIG. 1) accommodates the chocolate 3, whilst the opposite part, the bottom, is open and consists of four side flaps 26, 27, 28 and 29.

The flaps 26, 27, 28 and 29 project from the bottom surface 30 of the chocolate 3 and, as illustrated in FIG. 1, face away from the drum 8 and are substantially opposite, parallel pairs, and substantially parallel with the axis 19 of symmetry of the pick-up jaws 18. Two of the flaps, labelled 26 and 28, lie in two planes which are substantially parallel with the plane in which the second drum 8 lies and with the circular path P1.

Figure 1D:
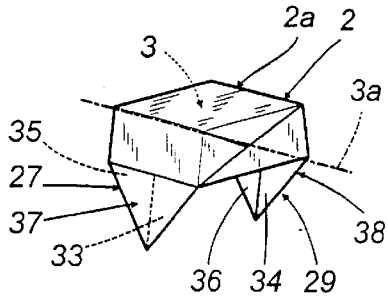
Figure 1E:
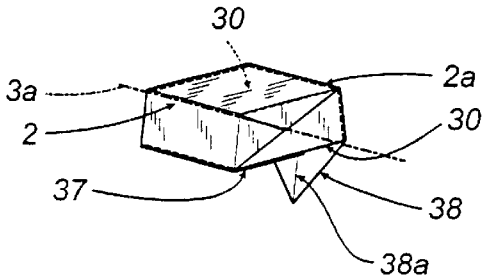

As is schematically and partially shown in FIG. 1, when the jaws 18 have left the station 20, they are designed to continuously feed the sets consisting of chocolates 3 and sheets 15 of wrapping material partially folded around the respective chocolate 3 in the intermediate wrapper configuration 2*a*, along the path P1, in a first direction D1 at a defined first speed V1, and downstream of the station 20, through a subsequent folding station 31, where the portion 1 of the wrapping machine comprises a folding device 32 designed to fold the flaps 26 and 28 squarely towards one another and in contact with the bottom surface 30 of the chocolate 3, to obtain a further intermediate wrapper 2*a* shaped as illustrated in FIG. 1*d*. At the same time, each of the other two flaps 27, 29, which are parallel to each other and perpendicular to the flaps 26, 28, form two triangular end portions, labelled 33, 35 and, respectively, 34, 36, in such a way as to change the shape of the flaps 27, 29, which assume a substantially triangular shape and form a first wing and a second wing, labelled 37 and 38, respectively, which are substantially parallel with each other and perpendicular to the bottom surface 30 of the chocolate 3, and which project from opposite edges of said surface 30 of the chocolate 3.

Figure 1F:
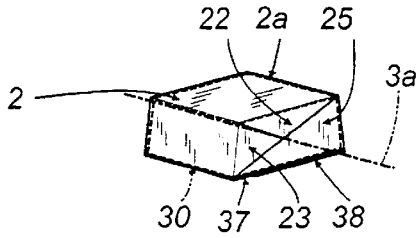

As illustrated in FIG. 1 and in FIGS. 2 to 9, where only one or two peripheral pick-up units 16 are shown, the wrapping machine portion 1 at the folding station 31 comprises a wrapping device 41 designed to fold the first and second wings 37, 38 one after the other and over each other until a closed wrapper 2 like that illustrated in FIG. 1*f* is obtained.

FIG. 1 also shows that the wrapping device 41 is supported by a frame 42 which is in turn supported by, and in such a way that it projects from, the frame 4 of the wrapping machine portion 1, through the wall 5, below the second drum 8 and the corresponding peripheral pick-up units 16.

In a preferred embodiment of the wrapping device 41, illustrated in more detail in FIGS. 2 to 9, the wrapping device 41 comprises a first folding device 43 which cooperates with the first and second wings 37, 38 as the product 3 and the intermediate wrapper 2*a* move forward continuously in the first direction D1 along an intermediate folding portion 44 of the first path P1. The first folding device 43 moves along a second, closed path P2, which lies in substantially the same plane as the path P1, under the action of corresponding drive means labelled 46 as a whole.

The drive means 46 comprise a linkage 47 which is located under the peripheral pick-up units 16 and under the first path P1 and which lies in a plane that is substantially the same plane as that which the first path P1 lies in.

The linkage 47 comprises a crank 48, constituting a first driving part of the linkage 47, one end of it being linked to a first drive shaft 49 that is in turn rotatably connected to the wall 5 of the frame 4 and turning about an axis 50 that is parallel with the axis 17 of the second drum B.

The crank 48 rotates continuously about the axis 50 of the first shaft 49, from which it receives its motion, in an counterclockwise direction indicated by the arrow F1 (FIG. 3), and its other end is linked to a first end of a connecting rod 51 which is in turn linked, at a point 52 half way along it, to a first end of a rocker arm 53.

The other end of the rocker arm 53 is linked to a first end of an arm 54 whose other end is linked to a second drive shaft 55 that is rotatably connected to the wall 5.

The connecting rod 51 has, on the other side of the midpoint 52 that links it to the rocker arm 53, an extension 51' whose free end is equipped with a folding tool 56 designed to come into contact with the first and second wings 37, 38.

The second drive shaft 55 oscillates about its axis 57, which is parallel with the axis 50 of the first shaft 49, in such a way as to make the first end of the arm 54 linkaged to the rocker arm 53 move with rotary oscillating motion in a clockwise direction towards the first path P1, as indicated by the arrow F2, and then in a direction opposite to this, away from the first path P1, as indicated by the arrow F3. The rotary oscillating motion of the arm 54, that constitutes a second drive part of the linkage 47, acts in conjunction and is synchronized with the continuous rotary motion of the crank 48 and, in particular during its clockwise oscillation F2 towards the product 3 and the relative intermediate wrapper 2*a*, is able to alter the path P2 that the folding tool 56 would otherwise follow if driven only by the crank 48, thus causing the folding tool 56 to follow a path P2 that has a section 45 where the folding tool comes into contact and folds the first and second wings 37, 38 and which substantially coincides with the intermediate folding portion 44 of the first path P1.

Figure 2:
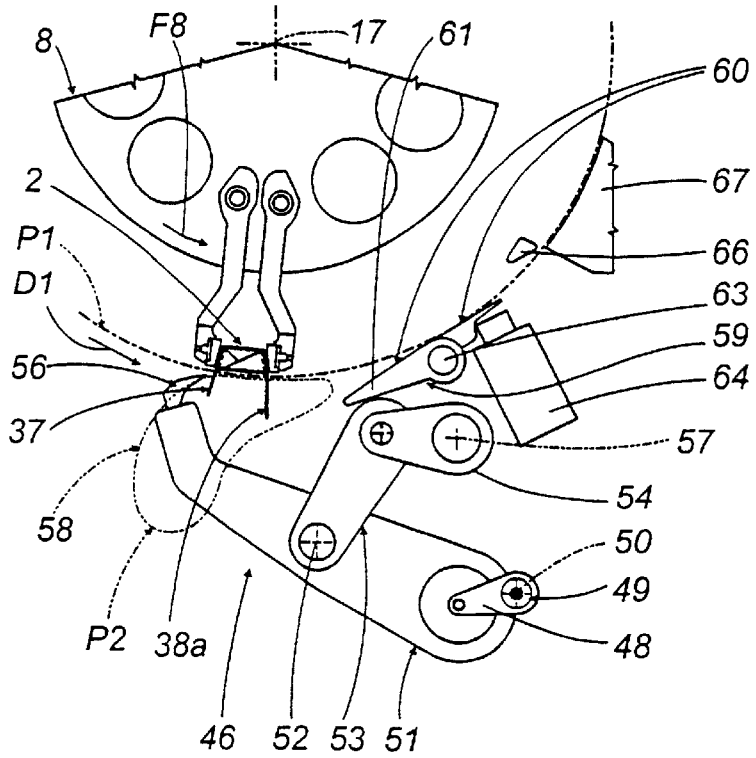

As illustrated in particular in FIGS. 1 and 2, the folding tool 56 moves cyclically and continuously along the second path P2 and, following the anticlockwise rotation of the crank 48 and the rotary oscillation of the arm 54 according to the arrow F2, interferes with the intermediate folding portion 44 of the first path P1, moving along the contact and folding section 45 of the closed path P2 in a second direction D2 that substantially coincides with the first direction D1, and at a second speed V2 that is faster than the first speed V1 at which the products 3 and the corresponding intermediate wrappers 2*a* are moving along the first path P1.

FIGS. 2 to 9 also show that the law of motion followed by the folding tool 56 as it moves along the section 45 of the closed path P2 is the result of combining a first movement towards the first wing 37, during which the tool 56, following the rotation of the crank 48 and the rotary oscillation of the arm 54, moves along an arched portion 58 of the second path P2, where the concave part of the arc faces the folding tool 56, with a second movement, different from the first, for folding the first and second wings 37, 38, during which the folder 56 moves along the contact and folding section 45, which is again arched, but with the concave part of the arc facing the drum 8, and coincides with the intermediate folding portion 44 of the first path P1, so that the orientation of the folding tool relative to the product 3 and the corresponding intermediate wrapper 2*a* remains constant.

From the above description, again with reference to FIGS. 2 to 9, it can be seen that the folding tool 56, as it moves along the section 45 of the closed path P2, squarely folds the first wing 37 towards the bottom surface 30 of the product 3 and then folds the second wing 38 away from the surface 30 of the product 3 until it extends from the surface 30 substantially in the same plane.

As shown in FIGS. 1 to 9, on the first path P1 and in the first direction D1 downstream of the first folder 43, the wrapping device 41 comprises contact and guide means 59 consisting of a contact plate 60 extending in the first direction D1 and positioned under and close to the first path P1.

The plate 60 has a movable guide 61 and a fixed bracket 62 which is substantially V-shaped and supported by the wall 5.

Figure 4:
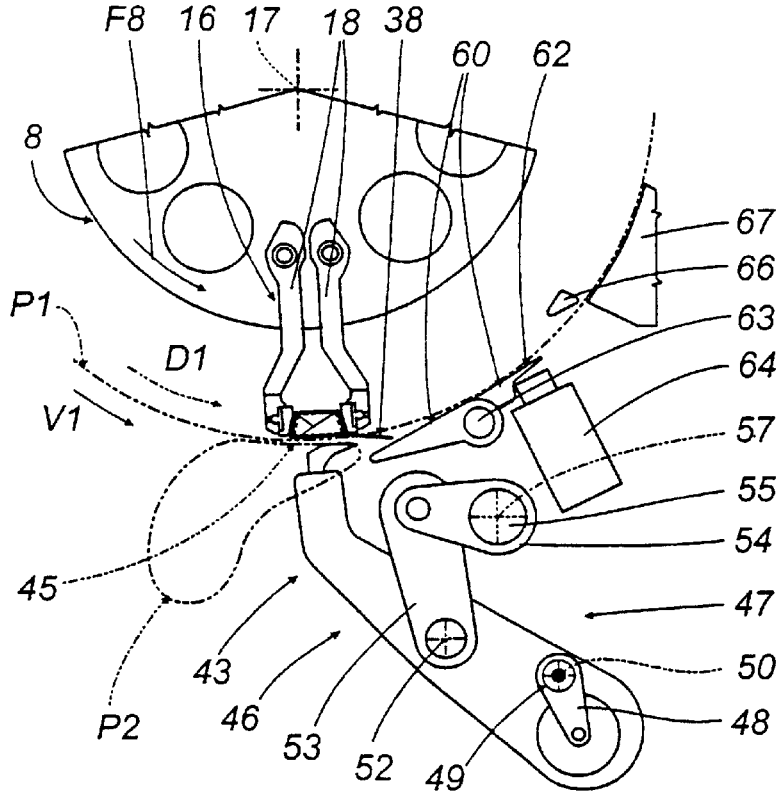
Figure 5:
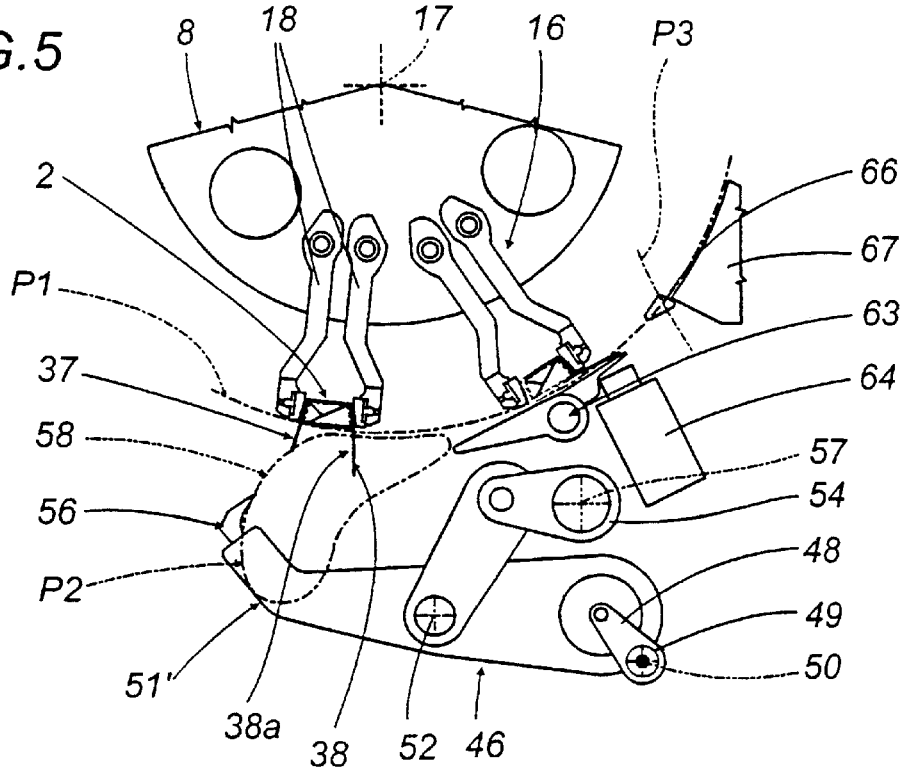

The guide 61 is connected at one end to a third drive shaft 63, the latter being rotatably connected to the wall 5 and designed to move the guide 61 from a low, inoperative position to a high operative position close to the path P1 so as to contact and guide the first and second wings 37, 38 in such a way that, as the product 3 and the corresponding intermediate wrapper 2*a* move along the path P1, both the guide 61 and the bracket 62 can keep said first and second wings 37, 38 folded in the respective positions reached after being folded by the first folder 43 (FIGS. 4 and 5).

At the bracket 62, the wrapping device 41 is equipped with a gumming device 64 positioned under the bracket 62 and designed to apply adhesive to a portion of the inner surface 38*a* of the second wing 38 when the second wing 38, after being folded away from the bottom surface 30 of the product 3 by the first folder 43, is in the above mentioned position where it extends from the surface 30 in the same plane and has moved along the path P1 to reach the bracket 62.

As shown in FIGS. 1 to 9, on the first path P1 and in the first direction D1 downstream of the first folder 43, the wrapping device 41 also comprises a second folder 65 designed to cooperate with the second wing 38 as the intermediate wrapper 2*a* and the product 3 move together along the intermediate folding portion 44 of the path P1 so as to fold the second wing 38 towards the bottom surface 30 of the product 3.

The second folder 65 comprises a contact element 66 that moves along a path P3, substantially transversal to the first path P1, in synchrony with the feed motion of the products 3 and the corresponding intermediate wrappers 2*a*, from a first upper operative position where it stops, waits and makes initial contact with the second wing 38, and where the contact element 66 is positioned above the first path P1 to a second lower operative position where it makes further contact with and partially folds the second wing 38.

When it has reached the second operative position, the contact element 66 is past the path P1 and moving away from it along the feed path P3 which extends in substantially the same direction as the first and second wings 37, 38 when these project from the bottom surface 30 of the product 3.

After being partially folded and held in place by the contact element 66, the second wing 38 continues moving along the P1 and is completely folded towards the bottom surface 30 of the product 3 so that its gummed portion comes into contact with the first wing 37.

During operation, with reference to FIG. 1, each set consisting of a chocolate 3 and an intermediate wrapper 2*a*, gripped and held by a corresponding pair of jaws 18, moves along the path P1 with the flaps 28 and 26 (FIG. 1*c*) opposite each other and parallel on opposite sides of the path P1, and reaches the folding device 32 at the folding station 31, which extends along the entire intermediate folding portion 44 of the path P1; the device 32 folds the flaps 26 and 28 in the manner described above in order to form the first and second wings 37, 38.

As shown in FIG. 2, after the folding step performed by the device 32, the first drive shaft 39 starts the crank 48 which begins turning continuously in direction F1 about the axis 50 of the shaft 49, causing the connecting rod 51 to oscillate about its midpoint, where it is linked to the rocker arm 53, as a result of which the first folding device 43 starts moving along the second path P2.

Figure 3:
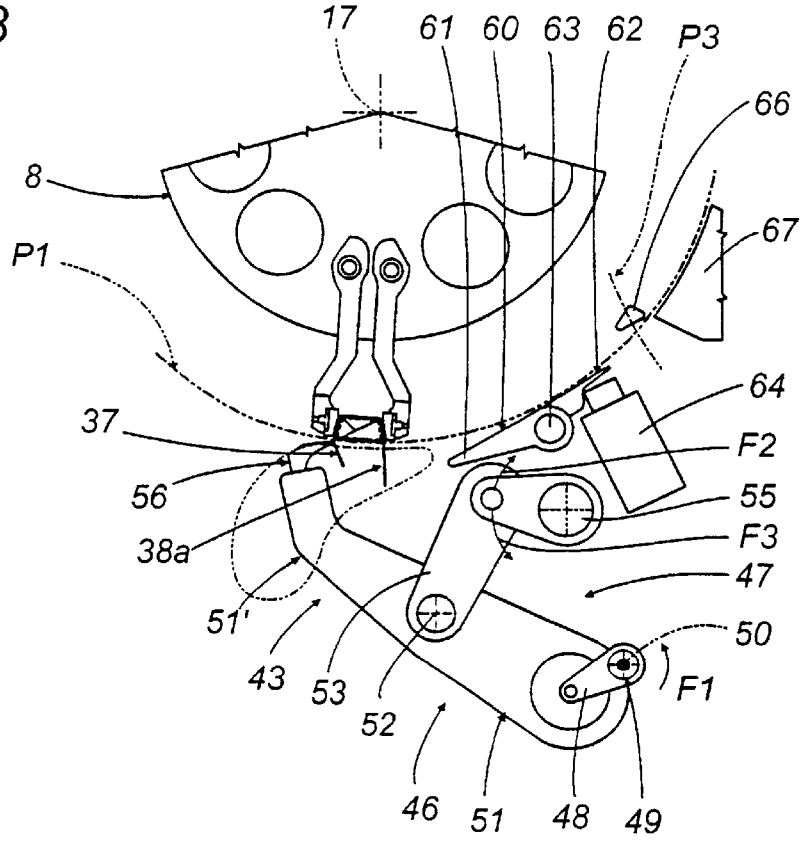

At the same time, as shown in FIGS. 3 and 4, the second drive shaft 55 rotates by a few degrees clockwise, causing the arm 54 to oscillate in direction F2 by a few degrees. As a result of this, the rocker arm 53 rises and the folding tool 56 of the first folding device 43, located at the end of the extension 51' of the connecting rod 51, follows the path P2, being constrained to alter the path that it would otherwise follow if it were driven only by the crank 48. The folder 56 then starts moving towards the first wing 37, moving along an arched portion 58 of the second path P2, where the concave part of the arc faces down, at a speed V2 that is greater than the speed V1 at which the corresponding product 3-wrapper 2*a* set moves along the intermediate folding portion 44 of the path P1 in the first direction D1. At the same time, as soon as the tool 56 contacts the first wing 37, the second drive shaft 55 rotates by another few degrees clockwise, causing the arm 54 to oscillate by another few degrees in the same direction F2.

As a result, as shown in FIG. 3, the folding tool 56 starts moving along the contact and folding section 45 following a path that differs from the feed path it follows to approach the wing 37 and that has the shape of an arc where the concave part faces up and coincides with the intermediate folding portion 44 of the path P1.

Looking in more detail, with reference to FIG. 4, the folding tool 56 moves forward along the section 45 in the second direction D2, which coincides with the direction D1 in which the product 3-wrapper 2*a* moves, and first squarely folds the first wing 37, by rotating it counterclockwise in direction D1 towards the bottom surface 30 of the product 3, and then folds the second wing 38 by rotating counterclockwise in direction D1 away from the surface 30 of the product 3 to a position such that it extends from the surface 30 in substantially the same plane.

Figure 6:
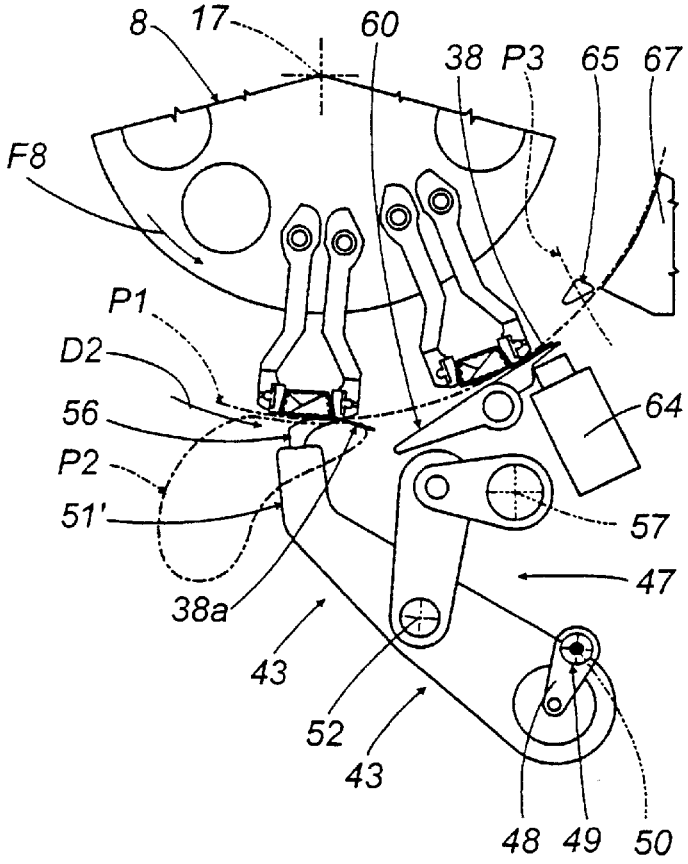
Figure 7:
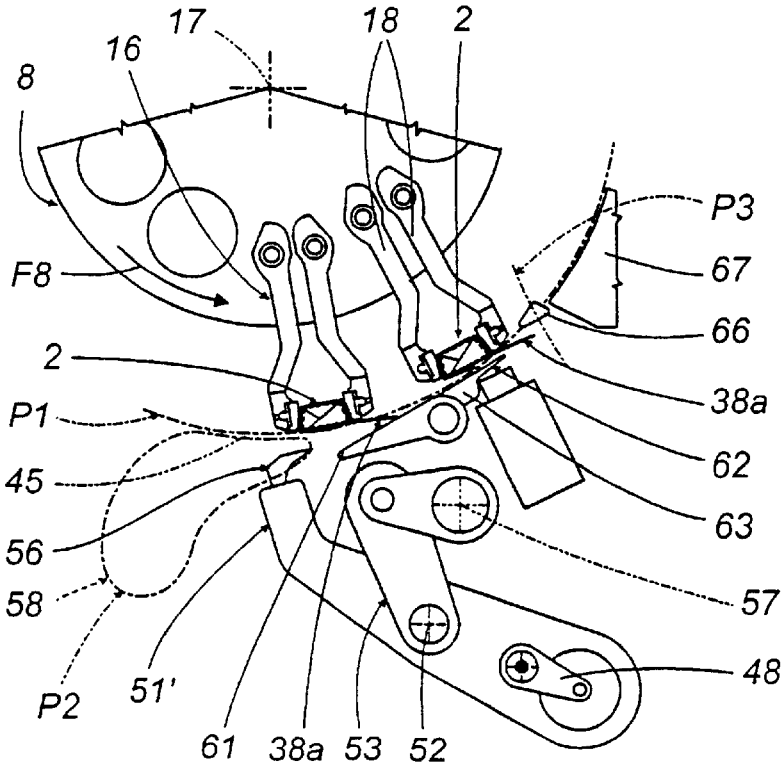

When, the step of folding the wings 37, 38 is over and as the product 3-wrapper 2*a* set moves along the portion 44 of the path P1, as shown in FIGS. 5, 6 and 7, the second wing first meets the guide 61 which is simultaneously driven upwards by the drive shaft 63 to its upper operative position and begins guiding the second wing 38 while keeping it in its folded position. After this, the guide 61 also guides the first wing 37 and keeps it in its folded position. When the second wing reaches the bracket 62, the gumming device 64 applies a layer of adhesive to a defined portion of the inner surface 38*a* of the wing 38, while the bracket 62 helps keen the second wing 38 folded.

Figure 8:
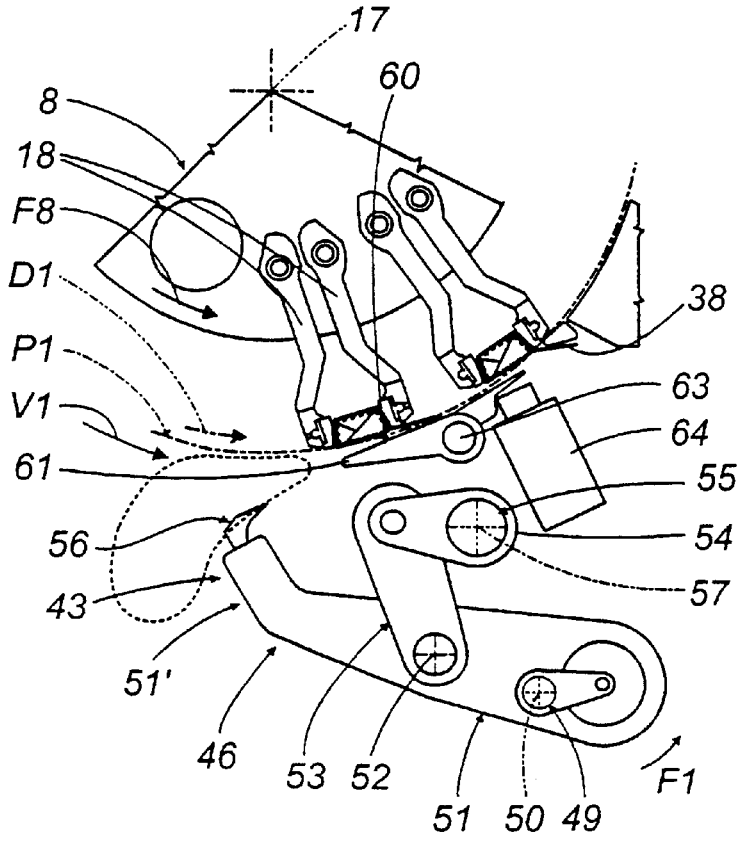
Figure 9:
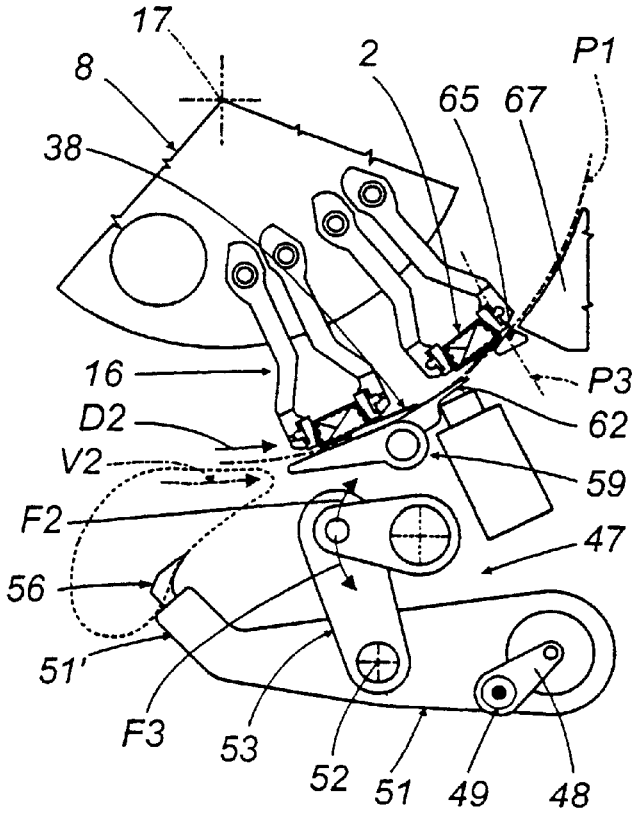

Proceeding along the portion 44 of the feed path P1, as illustrated in FIGS. 7, 8 and 9, the product 3-wrapper 2*a* set moves past the guide 61 and bracket 62, and the second wing 38 meets the contact element 66 which is simultaneously moving along the third path P3 away from the drum 8 and folds the wing 38 back completely towards the bottom surface 30 of the product 3, by rotating it clockwise in a direction opposite to direction D1, until the gummed portion of its inner surface 38*a* comes into contact with the first wing 37, thus closing the wrapper 2*a* completely around the product 3.

When the step of folding back the wing 38 is over, the product 3-wrapper 2*a* set proceeds along the path P1 and meets a fixed contact element 67 which keeps the two wings 37, 38 folded until the set 3-2*a* is released at a conventional pickup station (not illustrated).

As can be gleaned from FIGS. 5 to 9, the cycle of folding the wings 37 and 38, gumming and folding back the wing 38 is repeated each time a set 3-2*a* reaches the folding station 31.

It should be emphasized that during the steps of folding the wings 37 and 38, as described above, each peripheral unit 16 can oscillate relative to the drum 8, about the axis 39, parallel to the axis 17, under the action of the cam actuator device 40, both in the direction opposite D1 and in direction D1 in such a way as to respectively delay or advance the sets 3-2*a* relative to the first folding device 43 and thus ensuring that the steps of folding the wings 37 and 38 are carried out properly.

What is claimed is:

1. A method for continuously wrapping products, wherein it comprises the following steps: continuously feeding, at a first defined speed (V1), along a first path (P1) and in a given direction (D1), a succession of products (3) and the corresponding sheets (15) of wrapping material at least partially wrapped around the products (3) to V form an intermediate wrapper (2*a*) having a first and a second wing (37, 38) that are substantially transversal to the plane in which the first path (P1) lies, project from a surface (30) of the products (3) and are located on opposite sides of the product (3); folding the first wing (37) towards said product (3) surface (30) and folding the second wing (38) away from the surface (30) until it extends from the surface (30) itself in substantially the same plane using a first folding device (43) that cooperates with the first and second wings (37, 38) as the intermediate wrapper (2*a*) and the product (3) move forward continuously along an intermediate folding portion,(44) of the first path (P1); gumming at least one portion of the second wing (38); folding back the second wing (38) towards the product surface (30) until its gummed portion comes into contact with the first wing (37), using a second folding device (65) that cooperates with the second wing (38) as the intermediate wrapper (2*a*) and the product (3) move forward continuously along the intermediate folding portion (44).

2. The method according to claim 1 wherein the step of folding the first and second wings (37, 38) comprises a further step of keeping the first and second wings (37, 38) folded in the positions reached following said folding step, using means (59) for contacting and guiding said first and second wings (37, 38) as they move along the feed path (P1).

3. The method according to claim 1, wherein the gumming step follows the step of folding the second wing (38) away from the product (3) surface (30) when the second wing (38) has moved to the position where it extends from the surface (30) substantially in the same plane.

4. The method according to claim 1, wherein the step of folding the first and second wings (37, 38) is performed by using drive means (46) to move the first folding device (43) along a defined second path (P2), at least one section (45) of the second path (P2) being a section (45) for contacting and folding the first and second wings (37, 38); said contact and folding portion (45) substantially coinciding with the intermediate folding portion (44) of the first path (P1) so as to keep the orientation of the folding tool (43) relative to the product (3) and the corresponding intermediate wrapper (2*a*) constant as they move along the feed path (P1); the first folder (43) moving in the contact and folding section (45) in a second direction (D2) that substantially coincides with the first direction (D1) and at a second speed (V2) that is faster than the speed (V1) at which the products (3) and the corresponding intermediate wrappers (2*a*) move.

5. The method according to claim 4, wherein the second defined path (P2) is a closed path along which the first folder (43) is driven by the drive means (46) which comprise a linkage (47) designed to move the first folder (43) according to a defined law of motion such that the first folder (43) moves along the contact and folding section (45) which coincides with the intermediate folding portion (44) of the first path (P1) so that the orientation of the first folder (43) relative to the product (3) and the corresponding intermediate wrapper (2*a*) remains constant.

6. The method according to claim 5, wherein the linkage (47) comprises a crank (48) with one end linked to a connecting rod (51) and a rocker arm (53) with one end linked to a point (52) half way along the connecting rod (51), on the other side of which the connecting rod (51) has an extension (51') whose free end has a folding tool (56) designed to contact the first and second wings (37, 38); the rocker arm (53) being also linked to a first end of a mobile arm (54) whose second end is linked to a second shaft (55) from which it receives an oscillating motion designed to make the first end of the arm (54) move with oscillating motion in both directions; the oscillating motion of the arm (54) acting in conjunction and being synchronized with the continuous rotary motion of the crank (48) in such a way that the folding tool (56) moves along the feed portion (45) where it contacts and folds the first and second wings (37, 38) following the law of motion that is the result of combining a first movement towards the first wing (37), with a second movement, different from the first, for folding the first and second wings (37, 38), during which the folder (56) moves along the contact and folding section (45), which substantially coincides with the intermediate folding portion (44) of the first path (P1), so that the orientation of the folding tool relative to the product (3) and the corresponding intermediate wrapper (2*a*) remains constant.

7. The method according to claim 1, wherein the step of folding the first and second wings (37, 38) comprises a step of oscillating the corresponding product (3) and the intermediate wrapper (2*a*) in one direction and then in the opposite direction corresponding to the first direction (D1) along the first path (P1); the oscillating step being synchronized with the movement of the folding tool (56) as it runs along with contact and folding portion (45) that substantially coincides with the intermediate folding portion (44) of the first path (P1).

8. The method according to claim 1, wherein, for the step of folding back the second wing (38) towards the surface (30) of the product (3), the second folder (65) comprises a mobile contact element (66) designed to move along a third path (P3), substantially transversal to the first path (P1), in synchrony with the feed motion of the products (3) and the corresponding intermediate wrappers (2*a*), from a first upper operative position where it stops, waits and makes initial contact with the second wing (38) to a second lower operative position where it makes further contact with and partially folds the second wing (38), away from the first path (P1); the third path (P3) extending in substantially the same direction as the first and second wings (37, 38) when these project from the bottom surface (30) of the product (3).

9. A device for continuously wrapping products wherein it comprises, along a portion (1) of a wrapping machine equipped with a frame (4) and a wall (5), a wrapping device (6) comprising means (8; 16) for continuously feeding at a first defined speed (V1), along a first path (P1) and in a defined first direction (D1), a succession of products (3) and the corresponding sheets (15) of wrapping material at least partially wrapped around the products (3) to form an intermediate wrapper (2*a*) having a first and a second wing (37, 38) that are substantially transversal to the plane in which the first path (P1) lies, project from a surface (30) of the product (3) and are located on opposite sides of the product (3); a first folding device (43) that cooperates with the first and second wings (37, 38) as the intermediate wrapper (2*a*) and the product (3) move forward continuously along an intermediate folding portion (44) of the first path (P1) and that is designed to fold the first wing (37) towards said product (3) surface (30) and to fold the second wing (38) away from the surface (30) until it extends from the surface (30) itself in substantially the same plane; a gumming device (64) designed to apply an adhesive to at least one portion of the second wing (38); a second folding device (65) that cooperates with the second wing (38) as the intermediate wrapper (2*a*) and the product (3) move forward continuously along the intermediate folding portion (44) and that is designed to fold the second wing (38) towards the product surface (30) until its gummed portion comes into contact with the first wing (37).

10. The device according to claim 9, wherein it comprises drive means (46) for moving the first folder (43) along a second path (P2); at least one section (45) of the second path (P2) being a section (45) for contacting and folding the first and second wings (37, 38) and substantially coinciding with the intermediate folding portion (44) of the first path (P1) so as to keep the orientation of the folding tool (43) relative to the product (3) and the corresponding intermediate wrapper (2*a*) constant as they move along the first feed path (P1); said drive means (46) being positioned and made in such a way as to move the first folder (43), at least along the contact section (45), in a second direction (D2) that substantially coincides with the first direction (D1), and at a second speed (V2) that is faster than the first speed (V1) at which the products (3) and the corresponding intermediate wrappers (2*a*) are moving.

11. The device according to claim 10, wherein the drive means (46) comprise a linkage (47) designed to move the first folder (43) along the second path (P2), which is a closed path; the first folder (43) traveling along the closed path (P2) according to a defined law of motion such that the first folder (43) itself moves along the second contact and folding section (45), which substantially coincides with the intermediate folding portion (44) of the first path (P1) and in such a way that the orientation of the first folding tool (43) relative to the product (3) and the corresponding intermediate wrapper (2*a*) remains constant.

12. The device according to claim 11, wherein the linkage (47) is located under the feed means (8, 16) and under the first path (P1), lies in a plane that is substantially the same plane as that which the first path (P1) lies in, and comprises a crank (48), a first end of which is linked to a first drive shaft (49) that is in turn rotatably connected to the wall (5), and a second end of which is linked to a first end of a connecting rod (51); and a rocker arm (53) which is linked to a point (52) half way along it, on the other side of which the connecting rod (51) has an extension (51') whose free end is equipped with a folding tool (56) designed to come into contact with the first and second wings (37, 38); the rocker arm (53) being also linked to a first end of a mobile arm (54) whose second end is linked to a second drive shaft (55) that is rotatably connected to the wall (5); the second drive shaft (55) oscillating in such a way that the first end of the arm (54) oscillates in both directions; the oscillating motion of the arm (54) acting in conjunction and being synchronized with the continuous rotary motion of the crank (48) and being designed to make the folding tool (56) move along the feed portion (45) where it contacts and folds the first and second wings (37, 38) following the law of motion that is the result of combining a first movement towards the first wing (37), with a second movement, different from the first, for folding the first and second wings (37, 38), during which the folder (56) moves along the contact and folding section (45), which substantially coincides with the intermediate folding portion (44) of the first path (P1), so that the orientation of the folding tool (56) relative to the product (3) and the corresponding intermediate wrapper (2*a*) remains constant.

13. The device according to claim 9, wherein the feed means (8, 16) comprise a drum (8) that turns about an axis (17), is supported by the wall (5) and is equipped with a plurality of peripheral units (16) for picking up products (3) and corresponding intermediate wrappers (2*a*); each unit (16) being designed to oscillate relative to the drum (8) about an axis (39), which is parallel to the axis (17), under the action of a cam actuator device (40) in such a way as to make each product (3) and the corresponding intermediate wrapper (2*a*) oscillate in one direction and then in the opposite direction corresponding to the first direction (D1) along the first path (P1), the oscillation being synchronized with the movement of the folding tool (56) during its feed motion; the contact and folding section (45) coinciding with the intermediate folding portion (44) of the first path (P1).

14. The device according to claim 9, wherein it comprises means (59) for contacting and guiding said first and second wings (37, 38) as the intermediate wrapper (2*a*) and the product (3) move along the intermediate folding portion (44) of the first feed path (P1), in such a way as to keep the first and second wings (37, 38) folded in the respective positions reached after being folded by the first folder (43).

15. The device according to claim 14, wherein the contact and guide means (59) consist of a contact plane (60) extending in the first direction (D1) and positioned under and close to the first path (P1); the plate (60) having a movable guide (61) and a fixed bracket (62) which is substantially V-shaped and supported by the wall (5); the guide moving from a low inoperative position to a high operative position close to the path (P1) so as to contact and guide the first and second wings (37, 38) in such a way that, as the product (3) and the corresponding intermediate wrapper (2*a*) move along the path (P1), both the guide (61) and the bracket (62) can keep said first and second wings (37, 38) folded in the respective positions reached after being folded by the first folder (43).

16. The device according to claim 9, wherein the gumming device (64) is located at the contact and guide means (59) and is designed to apply adhesive to a portion of the second wing (38) when the second wing (38), after being folded away from the bottom surface (30) of the product (3) is in the above mentioned position where it extends from the surface (30) in the same plane.

17. The device according to claim 9, wherein the second folder (65) comprises a contact element (66) that moves along a path (P3), substantially transversal to the first path (P1), in synchrony with the feed motion of the products (3) and the corresponding intermediate wrappers (2*a*), from at least one first upper operative position where it stops, waits and makes initial contact with the second wing (38), to a second lower operative position where it makes further contact with and partially folds the second wing (38) away from the first path (P1) and substantially in the same direction as that in which the first and second wings (37, 38) lie when they project from the surface (30) of the product (3).

18. A device for continuously wrapping products wherein it comprises, along a portion (1) of a wrapping machine equipped with a frame (4) and a wall (5), a wrapping device (6) comprising means (8 16) for continuously feeding at a first defined speed (V1), along a first path (P1) and in a defined first direction (D1), a succession of products (3) and the corresponding sheets (15) of wrapping material at least partially wrapped around the products (3) to form an intermediate wrapper (2*a*) having a first and a second wing (37, 38) that are substantially transversal to the plane in which the first path (P1) lies, project from a surface (30) of the product (3) and are located on opposite sides of the product (3); a first folding device (43) that cooperates with the first and second wings (37, 38) as the intermediate wrapper (2*a*) and the product (3) move forward continuously along an intermediate folding portion (44) of the first path (P1) and that is designed to fold the first wing (37) towards said product (3) surface (30) and to fold the second wing (38) away from the surface (30); a gumming device (64) designed to apply an adhesive to at least one portion of the second wing (38); a second folding device (65) that cooperates with the second wing (38) as the intermediate wrapper (2*a*) and the product (3) move forward continuously along the intermediate folding portion (44) and that is designed to fold the second wing (38) towards the product surface (30) until its gummed portion comes into contact with the first wing (37);

the device comprising drive means (46) for moving the first folder (43) along a second path (P2); at least one section (45) of the second path (P2) being a section (45) for contacting and folding the first and second wings (37, 38) and substantially coinciding with the intermediate folding portion (44) of the first path (P1) so as to keep the orientation of the folding tool (43) relative to the product (3) and the corresponding intermediate wrapper (2*a*) constant as they move along the first feed path (P1); said drive means (46) being positioned and made in such a way as to move the first folder (43), at least along the contact section (45), in a second direction (D2) that substantially coincides with the first direction (D1), and at a second speed (V2) that is faster than the first speed (V1) at which the products (3) and the corresponding intermediate wrappers (2*a*) are moving, wherein the drive means (46) comprise a linkage (47) designed to move the first folder (43) along the second path (P2), which is a closed path; the first folder (43) traveling along the closed path (P2) according to a defined law of motion such that the first folder (43) itself moves along the second contact and folding section (45), which substantially coincides with the intermediate folding portion (44) of the first path (P1) and in such a way that the orientation of the first folding tool (43) relative to the product (3) and the corresponding intermediate wrapper (2*a*) remains constant, wherein the linkage (47) is located under the feed means (8, 16) and under the first path (P1), lies in a plane that is substantially the same plane as that which the first path (P1) lies in, and comprises a crank (48), a first end of which is linked to a first drive shaft (49) that is in turn rotatably connected to the wall (5), and a second end of which is linked to a first end of a connecting rod (51); and a rocker arm (53) which is linked to a point (52) half way along it, on the other side of which the connecting rod (51) has an extension (51') whose free end is equipped with a folding tool (56) designed to come into contact with the first and second wings (37, 38); the rocker arm (53) being also linked to a first end of a mobile arm (54) whose second end is linked to a second drive shaft (55) that is rotatably connected to the wall (5); the second drive shaft (55) oscillating in such a way that the first end of the arm (54) oscillates in both directions; the oscillating motion of the arm (54) acting in conjunction and being synchronized with the continuous rotary motion of the crank (48) and being designed to make the folding tool (56) move along the feed portion (45) where it contacts and folds the first and second wings (37, 38) following the law of motion that is the result of combining a first movement towards the first wing (37), with a second movement, different from the first, for folding the first and second wings (37, 38), during which the folder (56) moves along the contact and folding section (45), which substantially coincides with the intermediate folding portion (44) of the first path (P1), so that the orientation of the folding tool (56) relative to the product (3) and the corresponding intermediate wrapper (2*a*) remains constant.

* * * * *